US011649573B2

(12) United States Patent
Myogi et al.

(10) Patent No.: US 11,649,573 B2
(45) **Date of Patent: *May 16, 2023**

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 10 days.

This patent is subject to a terminal disclaimer.

(21) Appl. No.: 17/410,525

(22) Filed: Aug. 24, 2021

(65) Prior Publication Data

US 2022/0098765 A1 Mar. 31, 2022

(30) Foreign Application Priority Data

Sep. 30, 2020 (JP) ..... JP2020-165233

(51) Int. Cl.

| | |
|---|---|
| ***D03D 49/02*** | (2006.01) |
| ***D03C 9/06*** | (2006.01) |
| ***D03C 9/02*** | (2006.01) |
| *D03C 13/00* | (2006.01) |

(52) U.S. Cl.

CPC ..... *D03C 9/0608* (2013.01); *D03C 9/02* (2013.01)

(58) Field of Classification Search

CPC ..... D03D 49/02; D03D 49/027; D03J 1/14

See application file for complete search history.

(56) References Cited

U.S. PATENT DOCUMENTS

| | | | | |
|---|---|---|---|---|
| 644,322 A * | 2/1900 | Goldschmidt | ..... | D03J 1/14 28/198 |
| 669,394 A * | 3/1901 | Keene | ..... | D03J 1/14 28/208 |
| 1,191,112 A * | 7/1916 | Peterson | ..... | D03J 1/14 28/205 |

(Continued)

FOREIGN PATENT DOCUMENTS

| | | |
|---|---|---|
| CN | 100338282 C | 9/2007 |
| JP | S62-133150 A | 6/1987 |
| JP | H09-228193 A | 9/1997 |

OTHER PUBLICATIONS

Feb. 3, 2022, European Search Report issued for related EP Application No. 21193830.3.

*Primary Examiner* — Robert H Muromoto, Jr.
(74) *Attorney, Agent, or Firm* — Paratus Law Group, PLLC

(57) ABSTRACT

A loom includes a loom frame including a pair of side frames, and heddle frame guides. An inner wall of at least one side frame has, as a reference position, a position of a part, which supports the heddle frame guide in a warp direction, of an inner surface of the inner wall with respect to a width direction of the loom and at least one support part is formed to be an offset support part at which an inner end in a support position of a bearing is located on a more inner side of the loom frame than the reference position.

4 Claims, 5 Drawing Sheets

(56) References Cited

U.S. PATENT DOCUMENTS

| | | | | | |
|---|---|---|---|---|---|
| 1,342,896 | A * | 6/1920 | Colman | D03J 1/14 | 28/208 |
| 2,048,974 | A * | 7/1936 | Smith | D03J 1/14 | 28/178 |
| 2,705,022 | A * | 3/1955 | Picanol | D03D 49/02 | 139/1 R |
| 2,835,276 | A * | 5/1958 | Hunt | D03D 49/025 | 139/1 R |
| 2,911,012 | A * | 11/1959 | Egli | D03D 49/02 | 139/97 |
| 5,738,150 | A * | 4/1998 | Roelstraete | D03D 49/027 | 139/1 C |
| 2002/0046777 | A1 * | 4/2002 | Hirai | D03C 13/025 | 139/57 |

* cited by examiner

LOOM

CROSS-REFERENCE TO RELATED APPLICATION

The present application claims priority from Japanese Patent Application No. 2020-165233, filed on Sep. 30, 2020, the entire subject matter of which is incorporated herein by reference.

TECHNICAL FIELD

The present invention relates to a loom including a loom frame including a pair of side frame and heddle frame guides each attached to each of the side frames and configured to guide up-and-down movement of a heddle frame, wherein a rocking shaft, a main shaft, and a cloth winding roll bridged between both the side frames are supported on each of the side frames via support shafts and the support shafts are supported via bearings fitted in support parts provided in at least inner walls of the side frames.

BACKGROUND ART

As disclosed in JPH09-228193A, for example, a general loom has a rocking shaft and a main shaft (drive shaft) bridged between a pair of side frames of a loom frame. The rocking shaft and the main shaft are provided between both the side frames by being connected to support shafts supported via bearings with respect to each of an inner wall and an outer wall of each of the side frames.

The loom also has a winding mechanism configured to send the manufactured woven fabric toward a winding beam at a speed corresponding to a woven fabric density. The winding mechanism includes a cloth winding roll bridged between the pair of side frames. For reference, the cloth winding roll is also generally provided between both the side frames by being connected to support shafts supported on each of the side frames in the above-described form.

In addition, the loom has a pair of heddle frame guides for guiding up-and-down movement of a heddle frame of an opening device. The heddle frame guides are each provided on the loom in a form of being supported on each of the side frames.

Note that, the specification of the loom is defined based on a weaving width of a fabric to be woven. The heddle frame mounted on the loom has a width corresponding to the greatest weaving width that can be woven in the loom. In the loom, up-and-down movement of the heddle frame is guided by the pair of heddle frame guides, as described above. The heddle frame guides are each supported by means of brackets and the like each attached to the corresponding side frame.

For this reason, an interval between the pair of heddle frame guides is defined by positions of both the brackets in a width direction of the loom. Therefore, an interval between both the side frames to which the brackets are attached is set such that the pair of heddle frame guides supported on each of the side frames via the brackets is arranged at an interval at which they can guide the heddle frame as described above. Specifically, the interval between the pair of side frames of the loom frame is set such that the interval between positions in which the brackets are attached (positions in a warp direction, in which the heddle frame guides are supported) implements arrangement of the heddle frame guides as described above, and is determined based on the interval between the positions in which the brackets are attached taking into consideration a width of the heddle frame.

For reference, in most of the looms, the brackets are attached to the inner surfaces of the side frames. Specifically, a position of the side frame in which the bracket is attached is on the inner surface. In addition, the inner surface is substantially planar although there is slight unevenness.

SUMMARY OF INVENTION

In the loom, it is known that the rocking shaft, the main shaft and the cloth winding roll, which are long shaft members bridged between both the side frames, are caused to vibrate in association with the weaving.

Specifically, the rocking shaft for supporting a reed is subjected to an impact of beating resulting from reed's hitting a cloth fell of a woven fabric in association with a beating operation during weaving, and is thus caused to vibrate. In addition, the rocking shaft is connected to the main shaft via a motion converting mechanism such as a link mechanism, and is caused to rock as the main shaft is rotated. Therefore, the rocking shaft vibrates in association with the beating operation, so that the main shaft connected to the rocking shaft via the motion converting mechanism is also caused to vibrate.

The cloth winding roll is provided in such a form that the woven fabric is wound, so as to send the woven fabric manufactured as described above toward the winding beam, and the woven fabric is continuous with a warp of the cloth fell delivered from a warp beam. The woven fabric is subjected to the impact resulting from reed's hitting the cloth fell, as described above, and is also applied with a force of displacing the cloth fell in a front and rear direction by tension variation of the warp in association with the weaving. Accordingly, since the periodic force acts on the cloth winding roll via the woven fabric, the cloth winding roll is thus caused to vibrate.

The shaft members are provided in a form of being bridged between the pair of side frames of the loom frame, as described above. Therefore, when the shaft members are caused to vibrate as described above, both the side frames, and the entire loom frame is caused to vibrate. Particularly, in recent years, as an operation of the loom tends to increase in speed, the vibrations become more severe. The severe vibrations of the loom frame causes a noise problem and badly influences the weaving.

The present invention has been made in view of the above situations, and an object thereof is to provide a loom capable of suppressing the above-described problems as much as possible, where a rocking shaft, a main shaft, and a cloth winding roll bridged between both side frames are supported on each of the side frames via support shafts.

A preamble of the present invention is a loom including a loom frame including a pair of side frames and heddle frame guides each attached to each of the side frames and configured to guide up-and-down movement of a heddle frame, wherein a rocking shaft, a main shaft, and a cloth winding roll bridged between both the side frames are supported on each of the side frames via support shafts and the support shafts are supported via bearings fitted in support parts provided in at least inner walls of the side frames.

The present invention is characterized in that the inner wall of at least one side frame has, as a reference position, a position of a part, which supports the heddle frame guide in a warp direction, of an inner surface of the inner wall with respect to a width direction of the loom and at least one support part is formed to be an offset support part at which an inner end in a support position of the bearing is located on a more inner side of the loom frame than the reference position.

In the loom according to the present invention, the offset support part may be formed so that the support position of the bearing is located on a more inner side of the loom frame than the reference position. Further, the loom may be configured such that the support part configured to support the support shaft connected to the rocking shaft and/or the main shaft is to be the offset support part.

According to the present invention, in the loom where each of the shaft members bridged between both the side frames is supported via the support shaft by the support part provided in the inner wall of each side frame, at least one support part is formed to be an offset support part at which an inner end of the support position of the bearing fitted to the support part is located on a more inner side of the loom frame than the reference position. According to the loom configured in this way, the vibrations of the entire loom frame, which are caused in association with the weaving, are further suppressed, so that it is possible to suppress the noise problem and the bad influence on the weaving as much as possible.

More specifically, an interval between the pair of side frames of the loom is determined based on an interval between positions in which brackets corresponding to each of the heddle frame guides are attached. Further, according to the present invention, as for at least one of the pair of side frames whose interval is determined in such a way, at least one of the support parts is formed to be the offset support part. Thereby, the support position of the bearing at the offset support part is located on a more inner side in the width direction, as compared to the configuration (conventional configuration) of the loom (side frame) of the related art where an inner end of the support part is located in substantially the same position as the reference position.

Thereby, a position of an end portion (connecting end) on the shaft member-side of the support shaft supported in the offset support part is located on a more inner side, as compared to the conventional configuration. Therefore, an interval between a pair of connecting ends, at least one of the connecting ends being provided in this way, becomes smaller, as compared to the conventional configuration. As a result, the shaft member bridged between the pair of support shafts provided in this way becomes smaller in length dimension (a dimension in an axis line direction), as compared to the conventional configuration. The length dimension is reduced, so that the shaft member is more difficult to bend, and even when the impact caused due to the beating motion and the force caused due to the tension variation of the warp are applied, an amplitude of the vibrations accordingly caused is smaller, as compared to the conventional configuration.

Further, the side frame on which the support part is formed to be the offset support part is formed such that at least a part of the inner wall becoming the offset support part protrudes inward. Thereby, the side frame is increased in stiffness and is improved in vibration-proof characteristic, as compared to the conventional configuration where the inner wall is formed substantially planar.

In this way, according to the present invention, at least one of the shaft members such as a rocking shaft, a main shaft and a cloth winding roll, which are vibration generating sources of the vibrations of the side frame, is configured such that an amplitude of the vibrations during weaving is smaller, as compared to the conventional configuration, and the vibration-proof characteristic of the side frame itself is improved. Thereby, the vibrations of both the side frames during the weaving are suppressed, as compared to the conventional configuration. Therefore, the vibrations that occur on the entire loom frame are further suppressed, and the noise problem and the bad influence on the weaving are suppressed as much as possible.

Further, according to the loom of the present invention, the side frame on which the support part is formed to be the offset support part is further increased in stiffness and is more effectively improved in vibration-proof characteristic because the offset support part is formed so that the support position is located on the more inner side of the loom frame than the reference position. Thereby, the vibrations that occur on the entire loom frame are more effectively suppressed, and the noise problem and the bad influence on the weaving are more effectively suppressed.

Specifically, the side frame is formed with the offset support part, as described above. Thereby, the stiffness of the side frame is increased, so that the vibration-proof characteristic is improved. Further, the larger a protruding amount thereof is, a wall part extending in the width direction of the inner wall of the side frame becomes larger, so that the stiffness is further increased and the vibration-proof characteristic is thus further improved. Therefore, when the protruding amount is made larger, particularly, the offset support part of the side frame is formed so that the support position is located on the more inner side than the reference position, the side frame is further increased in stiffness and is more effectively improved in vibration-proof characteristic, as compared to a configuration where even when the inner end of the support position is located on the more inner side than the reference position, the support position overlaps the reference position (a part of the inner wall becoming the offset support part and a part including the reference position overlap each other). As a result, the vibrations that occur on the entire loom frame are more effectively suppressed, and the noise problem and the bad influence on the weaving are more effectively suppressed.

Further, according to the loom of the present invention, the offset support part is formed to be the support part for the support shaft for supporting the rocking shaft and/or the main shaft of the shaft members, so that the vibrations of the entire loom frame caused in association with the weaving can be more effectively suppressed.

Specifically, as described above, each of the shaft members bridged between both the side frames vibrates during the weaving. Among other things, the rocking shaft is applied with the impact caused in association with the beating motion and vibrates most violently. Therefore, the support part for the support shaft for supporting the rocking shaft and/or the support part for the support shaft for supporting the main shaft mechanically connected to the rocking shaft by a motion converting mechanism is formed as the offset support part, so that the vibrations of at least one of the two mechanically connected shaft members during the weaving are further suppressed and the vibrations of both the side frames are more effectively suppressed.

Figure 1:
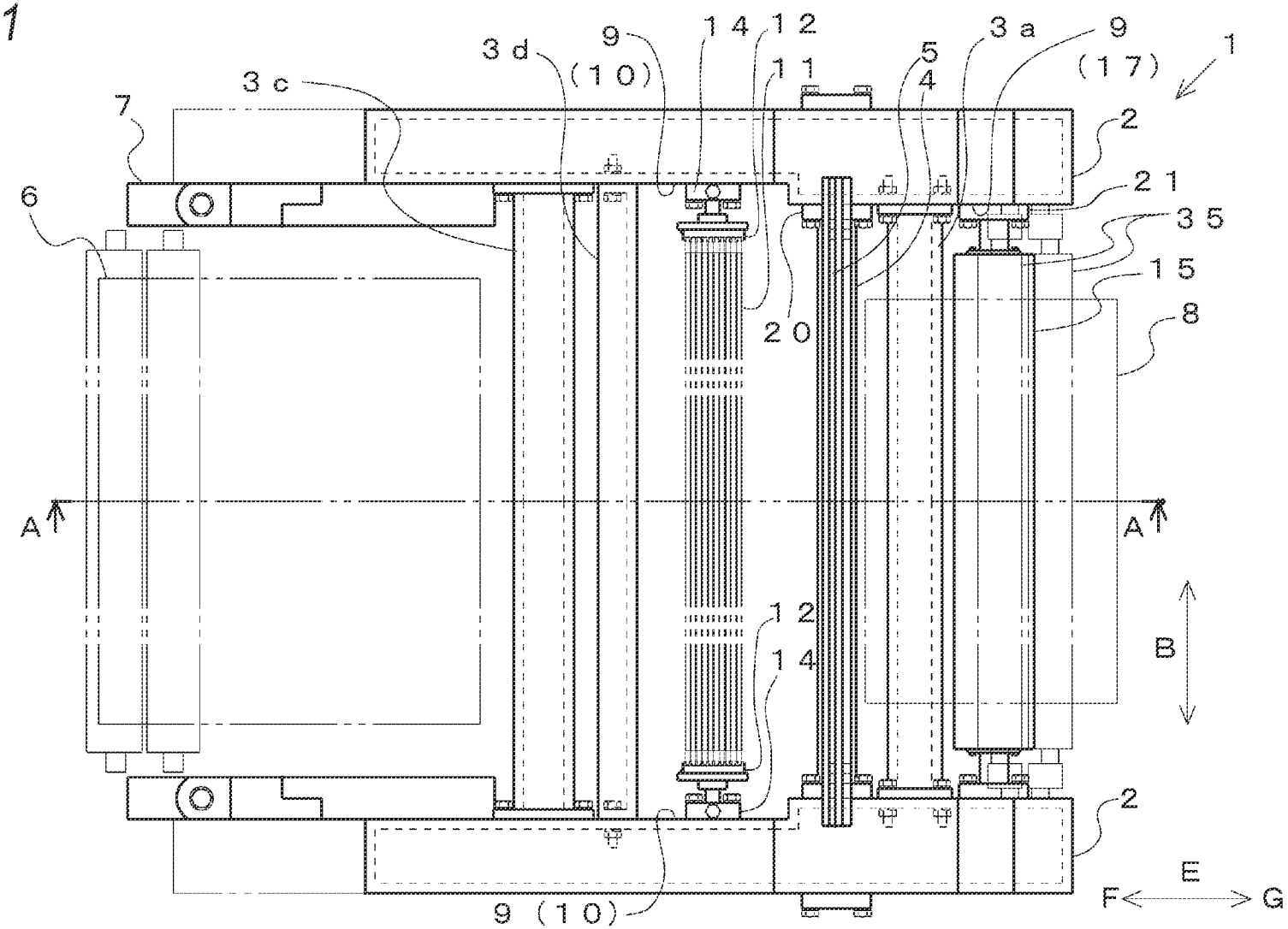
FIG. 1 is a top view of a frame of a loom to which the present invention is applied.
Figure 2:
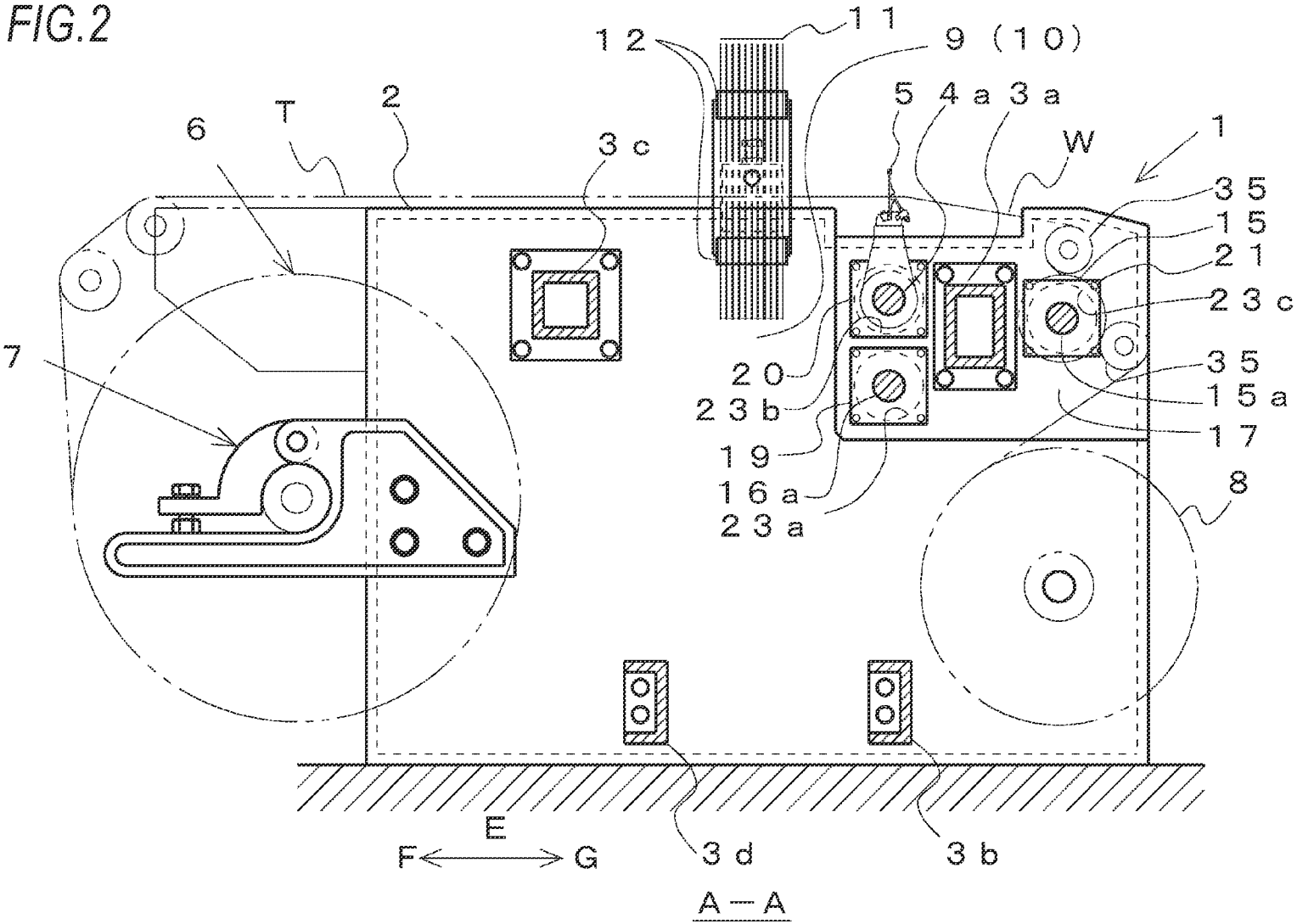
FIG. 2 is a sectional view taken along an A-A line in FIG. 1.
Figure 3:
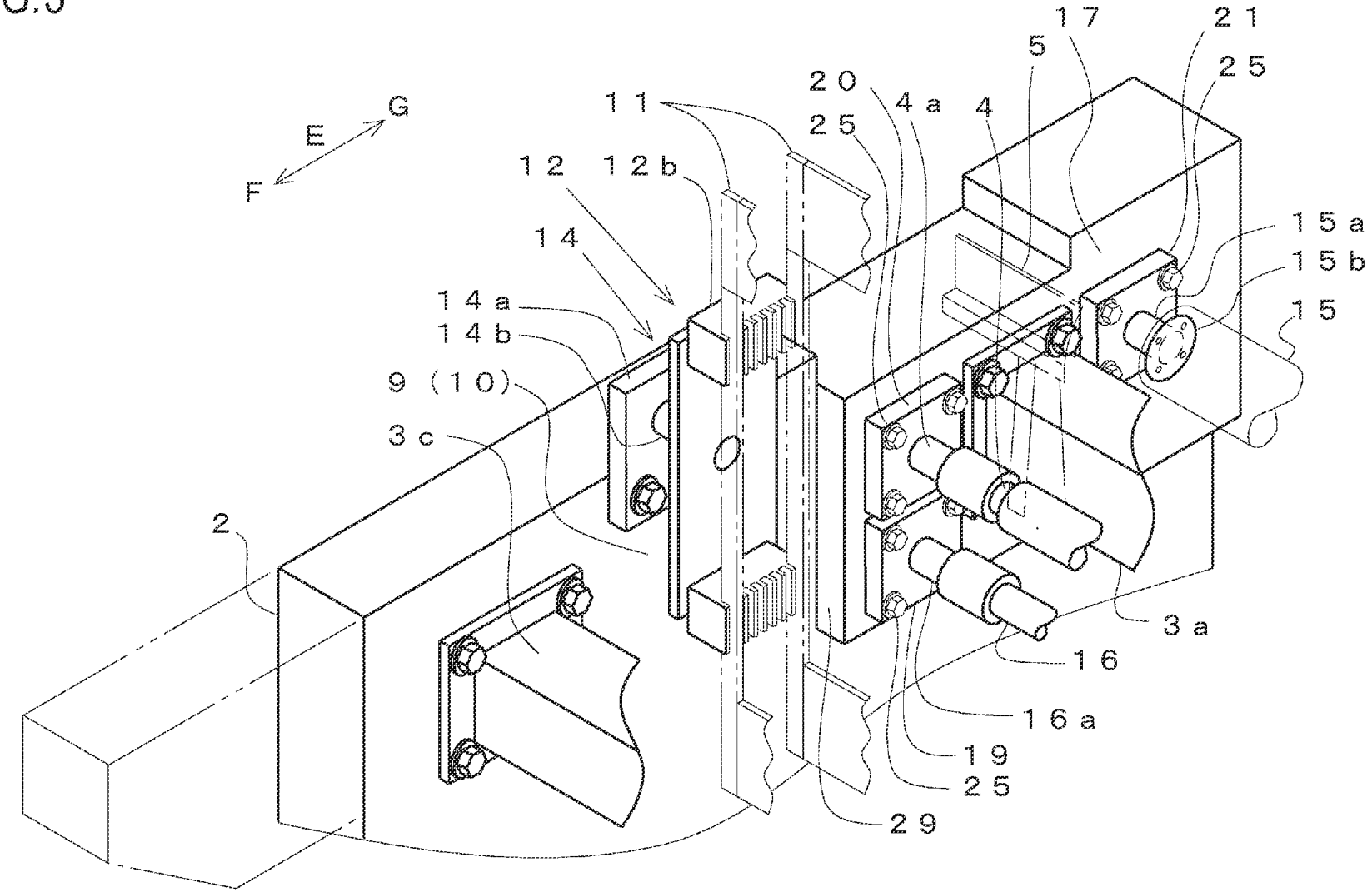
FIG. 3 is a partially enlarged perspective view of the frame of a loom shown in FIG. 1.

Hereinafter, an embodiment (present embodiment) of a frame of a loom to which the present invention is applied will be described with reference to FIGS. 1 to 5.

In a loom, a frame 1 has a pair of side frames 2 and 2 as a main body, and both the side frames 2 and 2 are connected by means of four beam members 3*a*, 3*b*, 3*c* and 3*d*. Note that, each of the side frames 2 has a housing shape having a space therein. Both the side frames 2 and 2 are connected by means of the beam members 3*a*, 3*b*, 3*c* and 3*d* with facing each other in a width direction (thickness direction=a width direction of the loom).

In the loom, a warp beam 6 for delivering a warp T is provided on one side in a front and rear direction of the loom in a form of being supported on both the side frames 2 and 2. In addition, a winding beam 8 for winding a manufactured woven fabric is provided on the other side in the front and rear direction of the loom in a form of being supported on both the side frames 2 and 2.

In addition, the loom has a pair of heddle frame guides 12 and 12 for guiding up-and-down movement of heddle frames 11 of an opening device. The heddle frame guides 12 are each provided on the loom in a form of being supported by means of brackets 14 each attached to the corresponding side frame 2. The brackets 14 are each fixed to the corresponding side frame 2 in a form of being fixed to an inner wall 27 of the side frame 2.

Note that, each of the brackets 14 is constituted by a plate-shaped support plate 14*a* attached to the frame and a support shaft 14*b* attached to the support plate 14*a* so as to protrude from one end face of the support plate 14*a*. Each of the brackets 14 is fixed to the inner wall 27 of the side frame 2 in such a form that the support shaft 14*b* is located above an upper surface of the side frame 2 and the support shaft 14*b* is faced toward an inner side of the loom (hereinafter, simply referred to as "inner side"). As for an attachment position, the support shaft 14*b* is located at a substantial center of the side frame 2 in the front and rear direction.

Each of the heddle frame guides 12 is supported on the corresponding side frame 2 via the bracket 14 in a form of being attached to a tip end portion of the support shaft 14*b* of the bracket 14. Therefore, as for a positional relationship in the width direction between the side frame 2 and the heddle frame guide 12, the heddle frame guide 12 is spaced from an inner surface 9 of the inner wall 27 of the side frame 2 about by the bracket 14.

The heddle frame guide 12 has two guide portions 12*b* provided at an interval in an upper and lower direction (vertical direction) in a state where the heddle frame guide 12 is supported on the side frame 2 as described above. Each of the guide portions 12*b* has a plurality of guide grooves for guiding up-and-down movement of a plurality of heddle frames 11 provided for the loom. In the loom, each of the heddle frames 11 is provided with both sides thereof being guided to the guide grooves of the pair of heddle frame guides 12 and 12.

In this way, a position of the guide groove of each of the heddle frame guides 12 is a position in which the heddle frame 11 is guided on a side of each of the side frames 2 of the loom. The guide position is defined by a position of the side frame 2 (inner surface 9) due to the positional relationship between the side frame 2 and the heddle frame guide 12 as described above. Therefore, a part (surface) of the inner surface 9 of the side frame 2, to which the bracket 14 is attached, is a reference surface 10 for defining the guide position, and a position of the reference surface 10 in the width direction becomes a position (reference position) becoming a reference for defining the guide position.

For reference, the specification of the loom is determined based on a weaving width of a fabric W to be woven. The heddle frame 11 mounted on the loom has a width corresponding to the specification (the greatest weaving width that can be woven) of the loom. Therefore, an interval between the pair of side frames 2 and 2 configured to support the pair of heddle frame guides 12 and 12 provided so as to guide the heddle frame 11 is set, taking into consideration a width of the heddle frame 11 and the positional relationship between the side frame 2 and the heddle frame guide 12. An interval between the pair of the reference surfaces 10 and 10 included in the pair of side frames 2 and 2 whose interval is set in such a way is also defined according to the interval between the side frames 2 and 2.

Further, as for the four beam members connecting the pair of side frames 2 and 2, the two beam members 3*a* and 3*b* are provided as beam members on the winding side (winding-side beam members 3*a* and 3*b*) arranged on the winding beam 8-side in the front and rear direction, and the two remaining beam members 3*c* and 3*d* are provided as beam members on the delivery side (delivery-side beam members 3*c* and 3*d*) arranged on the warp beam 6-side in the front and rear direction. The winding-side beam members 3*a* and 3*b* are arranged in different positions in the upper and lower direction, the upper beam member 3*a* is a so-called front top stay, and the lower beam member 3*b* is a so-called front bottom stay. The delivery-side beam members 3*c* and 3*d* are also arranged in different positions in the upper and lower direction, the upper beam member 3*c* is a so-called rear top stay, and the lower beam member 3*d* is a so-called rear bottom stay.

Note that, the front top stay 3*a* and the rear top stay 3*c* each have flanges formed at both end portions thereof. The flange is formed with a plurality of through-holes in which bolts for fixing are inserted. The bolts for fixing inserted in the through-holes of each of the flanges are inserted into through-holes formed to open to the inner surface 9 of the corresponding side frame 2 and are screwed with nuts, so that the front top stay 3*a* and the rear top stay 3*c* are fixed to each of the side frames 2 (inner surfaces 9). In this way, the front top stay 3*a* and the rear top stay 3*c* are fixed to the inner surfaces 9 of each of the side frames 2, thereby connecting both the side frames 2 and 2.

The front bottom stay 3*b* and the rear bottom stay 3*d* are each a beam member having a substantially U-shaped section and each have end walls formed at both end portions so as to close end portions. The end wall is formed with a plurality of through-holes in which bolts for fixing are inserted. The bolts for fixing inserted in the through-holes of each of the end walls are inserted into through-holes formed to open to the inner surface 9 of the corresponding side frame 2 and are screwed with nuts, so that the front bottom stay 3*b* and the rear bottom stay 3*d* are fixed to each of the side frames 2 (inner surfaces 9). In this way, the front bottom stay 3*b* and the rear bottom stay 3*d* are fixed to the inner surfaces 9 of each of the side frames 2, thereby connecting both the side frames 2 and 2.

A main shaft 16 of the loom is provided in a form of being bridged between both the side frames 2 and 2 in a direction parallel to the front top stay 3*a*, i.e., a direction parallel to a width direction of the loom (hereinafter, simply referred to as "width direction"). Note that, a support position of the main shaft 16 is a position between the front top stay 3*a* and the bracket 14 (heddle frame guide 12) in the front and rear direction, and is a position in which an upper end (upper edge) thereof is located near a lower surface of the front top stay 3*a*, in the upper and lower direction.

The loom also has a beating mechanism configured to rock a reed 5. In the beating mechanism, the reed 5 is supported on a rocking shaft 4 via a plurality of sley swords and the like. Further, the rocking shaft 4 is provided in a form of being bridged between both the side frames 2 and 2 in a direction parallel to the width direction. Note that, a support position of the rocking shaft 4 is substantially the same position as the main shaft 16 in the front and rear direction, and is a position above the main shaft 16 and overlapping the front top stay 3*a* in the upper and lower direction.

The loom also has a winding mechanism configured to send the manufactured woven fabric W toward the winding beam 8 at a speed corresponding to a woven fabric density. The winding mechanism includes a cloth winding roll 15 and a plurality of press rolls 35 and 35 provided to be pressed against the cloth winding roll 15 by means of a pressing mechanism (not shown). In addition, the cloth winding roll 15 is provided in a form of being bridged between both the side frames 2 and 2 in a direction parallel to the width direction. Note that, a support position of the cloth winding roll 15 is a position on an opposite to the main shaft 16 with respect to the front top stay 3*a* in the front and rear direction, and is a position overlapping the front top stay 3*a* in the upper and lower direction.

Each shaft member of the main shaft 16, the rocking shaft 4 and the cloth winding roll 15 bridged between both the side frames as described above is supported on each of the side frames 2 and 2 via each of support shafts 16*a*, 4*a* and 15*a*. Therefore, the loom has the support shafts 16*a*, 4*a* and 15*a* each corresponding to each of the shaft members, and each of the support shafts 16*a*, 4*a* and 15*a* is provided for the loom in a form of being supported on each of both the side frames 2 and 2 in a position in which the corresponding (supporting) shaft member is arranged on each of the side frames 2 and 2 as described above.

As for each of the support shafts 16*a*, 4*a* and 15*a*, the support shafts 16*a* and 16*a* for supporting the main shaft 16 and the support shafts 4*a* and 4*a* for supporting the rocking shaft 4 are each formed as a shaft having a dimension in an axis line direction (length dimension) greater than a thickness of the side frame (a dimension in the width direction). Each of the support shafts 16*a* and 4*a* is rotatably supported via bearings 22*a*, 22*b*, 22*d* and 22*e* with respect to the inner wall 27 and an outer wall 28 of the side frame 2, in a direction parallel to the width direction. Each of the support shafts 16*a* and 4*a* is provided in such a form that an end portion on one end-side protrudes from the inner wall 27 toward the inner side, in a state of being supported on the side frame 2 as described above.

Further, the main shaft 16 is connected at both end portions thereof to an end portion on the one end-side of each of the pair of support shafts 16*a* and 16*a* provided for each of both the side frames 2 and 2, and is thus bridged between both the side frames 2 and 2. Therefore, the end portion on the one end-side of the support shaft 16*a* is formed as a connecting end 16*c* of the support shaft 16*a* to the main shaft 16. Similarly, the rocking shaft 4 is connected at both end portions thereof to an end portion (connecting end 4*c*) on the one end-side of each of the pair of support shafts 4*a* and 4*a* and is thus bridged between both the side frames 2 and 2.

In the loom, the rocking shaft 4 is adapted to reciprocally rock by means of the main shaft 16 (support shaft 16*a*) that is rotationally driven. Therefore, the support shaft 16*a* is mechanically connected to the support shaft 4*a* via a motion converting mechanism (not shown) configured to convert rotation motion into rocking motion, in the side frame 2. Specifically, the support shaft 4*a* configured to support the rocking shaft 4 and the support shaft 16*a* configured to support the main shaft 16 are mechanically connected to each other by the motion converting mechanism. Note that, the motion converting mechanism is, for example, a crank mechanism or a cam mechanism.

The support shafts 15*a* and 15*a* for supporting the cloth winding roll 15 are each formed as a shaft member having a flange 15*b* at one end thereof. Each of the support shafts 15*a* is rotatably supported via a bearing 22*c* with respect to the inner wall 27 of the side frame 2, in a direction parallel to the width direction, in which the one end at which the flange 15*b* is provided is the inner side. The flange 15*b* of the support shaft 15*a* is formed with a plurality of through-holes in which bolts 15*c* for fixing for connecting the cloth winding roll 15 are inserted.

Further, the cloth winding roll 15 is connected at both end portions to the pair of support shafts 15*a* and 15*a* provided on each of both the side frames 2 and 2 and is thus bridged between both the side frames 2 and 2. Note that, the cloth winding roll 15 is connected to the pair of support shafts 15*a* and 15*a* by screwing the bolts 15*c* for fixing inserted in the through-holes of each flange 15*b* into female screw holes formed to open to end faces of the cloth winding roll 15. Therefore, the flange 15*b* serves as a connecting end of the support shaft 15*a* to the cloth winding roll 15.

In the loom as described above, in the present invention, at least one of support parts, which are parts of the inner wall 27 becoming support positions of each of the support shafts 16*a*, 4*a* and 15*a* on one or both of the pair of side frames, is formed to be an offset support part at which an inner end of the support position of the bearing arranged so as to support the support shaft corresponding to the support part is located on the more inner side than the reference position. The present embodiment is an example where all of the support parts of both the side frames 2 and 2 are formed as an offset support part 17. The loom of the present embodiment is specifically described as follows.

As described above, on each side frame 2, each of the support shafts 16*a*, 4*a* and 15*a* is supported in a form of protruding toward the inner side. Therefore, the inner wall 27 of each side frame 2 is formed with through-holes 23*a*, 23*b* and 23*c* for enabling the support shafts 16*a*, 4*a* and 15*a* to protrude. Further, the inner wall 27 of each side frame 2 is formed so that a range including the through-holes 23*a*. 23*b* and 23*c*, as seen in the width direction, protrudes with respect to apart of the inner wall 27 including the reference surface 10. Specifically, the side frame 2 has a protrusion part 17 that protrudes with respect to the reference surface 10 within the range. Note that, a thickness dimension of the inner wall 27 is substantially uniform, and a thickness dimension of the part including the reference surface 10 and a thickness dimension of the part of the protrusion part 17, in which the through-holes 23*a*, 23*b* and 23*c* are formed, are substantially the same.

Note that, the support positions of the main shaft 16, the rocking shaft 4 and the cloth winding roll 15 with respect to the front top stay 3*a* are the above-described positions. Therefore, a range (a range of the protrusion part 17) including the positions (i.e., the positions in which the through-holes 23*a*, 23*b* and 23*c* are formed) in which the support shafts 16*a*, 4*a* and 15*a* are provided as seen in the width direction includes a position in which the front top stay 3*a* is attached to the side frame 2.

In addition, the protrusion part 17 is formed such that a protruding amount from the reference surface 10 (reference position) is greater than the thickness dimension of the inner wall 27. A peripheral part of the protrusion part 17 in the above range is formed as a wall part 29 that extends in the width direction of the loom in a size corresponding to the protruding amount.

Further, the bearings 22*a*, 22*b* and 22*c* for supporting the support shafts 16*a*. 4*a* and 15*a* are attached to each side frame 2 via the bearing holders 19, 20 and 21. Note that, the bearing holders 19, 20 and 21 have the same configuration. Therefore, the bearing holder 19 for the supporting the support shaft 16*a* is exemplarily described in the below.

Figure 4:
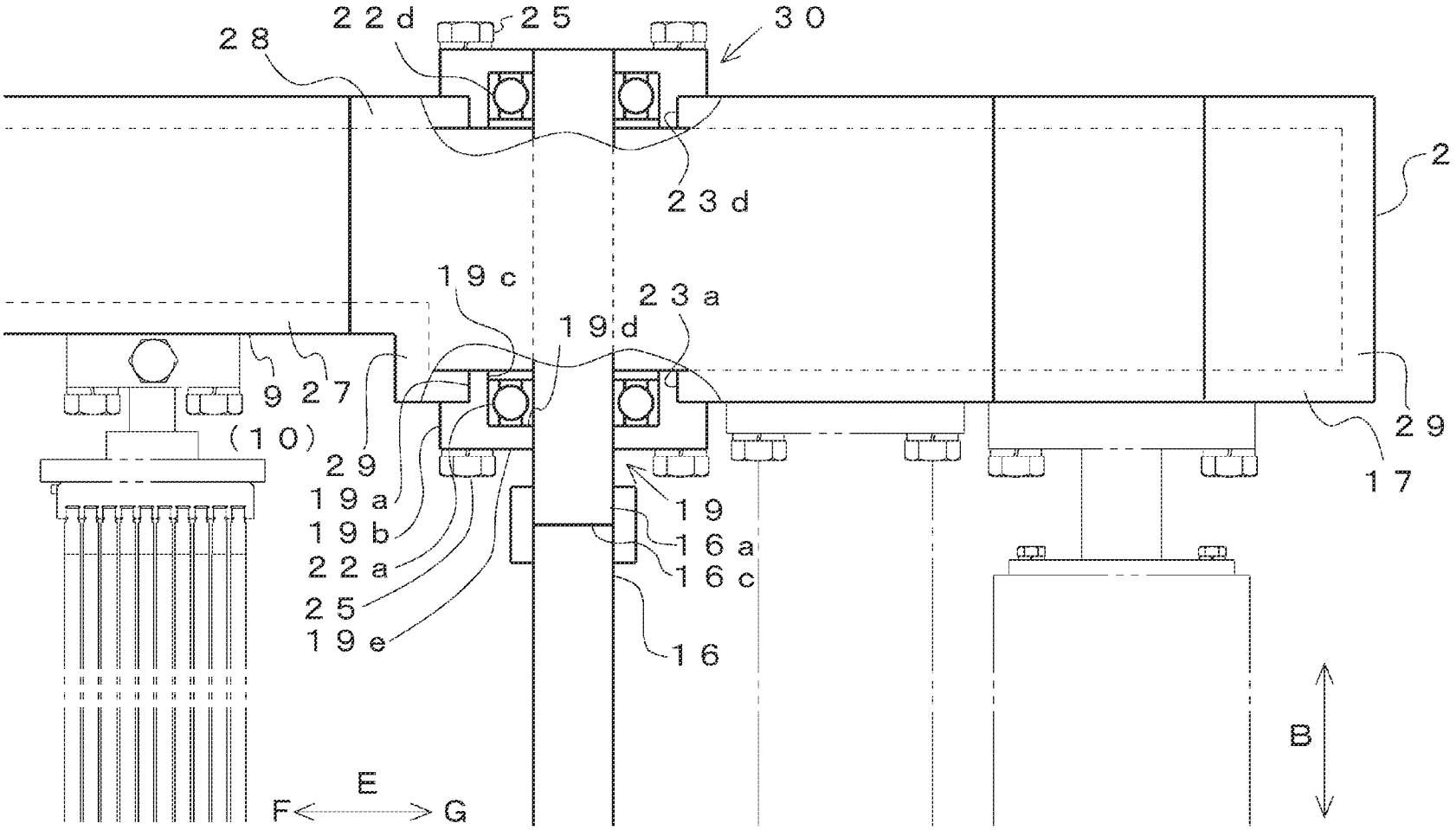
FIG. 4 is a partially enlarged sectional view of the frame of a loom shown in FIG. 1.

As shown in FIG. 4, the bearing holder 19 is constituted by a cylindrical fitting/insertion portion 19*a* having a through-hole 19*c*, as a main body. The bearing holder 19 has a flange portion 19*b* formed on one end-side of the fitting/insertion portion 19*a* in an axis line direction. The bearing 22*a* is provided in the bearing holder 19 in a form of being accommodated in the through-hole 19*c* of the fitting/insertion portion 19*a*. Therefore, an inner diameter of the through-hole 19*c* of the fitting/insertion portion 19*a* is sized to accommodate the bearing 22*a* in a fitted state. In addition, a dimension of the through-hole 19*c* in the axis line direction is greater than a width dimension (thickness dimension) of the bearing 22*a*.

However, the through-hole 19*c* is formed so that the inner diameter becomes smaller at an end portion on the one end-side. Specifically, the through-hole 19*c* is formed by a portion (accommodation portion) configured to accommodate the bearing 22*a* and a small-diameter portion on the one end-side with respect to the accommodation portion. Therefore, the fitting/insertion portion 19*a* has an end wall 19*e*, in which the small-diameter portion of the through-hole 19*c* is formed, at an end portion on one end portion-side. An inner diameter of the small-diameter portion of the through-hole 19*c* formed in the end wall 19*e* substantially coincides with an outer diameter of a portion of the support shaft 16*a*, which is supported by the bearing 22*a*. Further, the accommodation portion of the through-hole 19*c* is formed so that a length dimension in the axis line direction is greater than a thickness dimension of the bearing 22*a*. The bearing 22*a* is accommodated in the bearing holder 19 in a state where it is fitted/inserted in the accommodation portion of the through-hole 19*c* and an end face on one side is in contact with the end wall 19*e*.

The flange portion 19*b* is formed on the one end-side of the fitting/insertion portion 19*a*, as described above, and is formed to be thicker than a thickness dimension of the end wall 19*e* of the fitting/insertion portion 19*a*. A thickness dimension of the flange portion 19*b* is set so that a difference from the dimension of the bearing holder 19 (fitting/insertion portion 19*a*) in the axis line direction is substantially the same as the thickness dimension of the inner wall 27. The flange portion 19*b* is formed with a plurality of through-holes in which the bolts 25 for fixing the bearing holder 19 to the side frame 2 (protrusion part 17) are inserted.

Further, the bearing holder 19 is fixed to the side frame 2 in such a form that the fitting/insertion portion 19*a* is fitted in the through-hole 23*a* in a state where the bearing 22*a* is accommodated as described above. Therefore, the through-hole 23*a* is formed so that an inner diameter thereof is sized to correspond to an outer diameter of the fitting/insertion portion 19*a*. In addition, the bearing holder 19 is fixed to the side frame 2 by screwing the bolts 25 for fixing inserted in the through-holes of the flange portion 19*b* into female screw holes formed to open to the inner surface 9 of the corresponding protrusion part 17.

As described above, in the loom of the present embodiment, the main shaft 16 is supported on each side frame 2 via each support shaft 16*a*, and each support shaft 16*a* is supported via the bearing holder 19 fixed to the side frame 2 in a form of being fitted in the through-hole 23*a* and the bearing 22*a* accommodated in the bearing holder 19. Therefore, in the loom, the part in which the through-hole 23*a* is formed is formed as a support part of the support shaft 16*a* for the main shaft 16, in the inner wall 27 of the side frame 2.

Further, the through-hole 23*a* is formed in the protrusion part 17 of the inner wall 27, and in the bearing holder 19 configured as described above, a position of an inner end of the accommodated bearing 22*a* (which is an inner end of the support position of the bearing 22*a* and is also an end face of the end wall 19*e* on the bearing 22*a*-side) is located on the more inner side than the inner surface 9 of the protrusion part 17. Therefore, the support part in the inner wall 27, which is a part for supporting the support shaft 16*a* via the bearing holder 19, corresponds to the offset support part of the present invention.

Further, in the loom of the present embodiment, as described above, the protruding amount of the protrusion part 17 with respect to the reference position is greater than the thickness dimension of the inner wall 27. Therefore, a position of a side surface, which faces toward the inner surface of the side frame 2, of both side surfaces of the protrusion part 17 is located on the more inner side than the reference position with respect to the width direction. Further, the bearing holder 19 that is attached to the protrusion part 17 is formed such that the difference between the thickness dimension of the flange portion 19*b* and the dimension of the bearing holder 19 in the axis line direction is substantially the same as the thickness dimension of the inner wall 27. In other words, a dimension in the axis line direction of a part of the bearing holder 19 except the flange portion 19*b* is substantially the same as the thickness dimension of the inner wall 27.

Thereby, a position of an end edge of the bearing holder 19 on an opposite side to the flange portion 19*b* is the same as the position of the side surface, which faces toward the inner side, of the protrusion part 17 with respect to the width direction. Since the bearing 22*a* is supported in a form of being accommodated in the bearing holder 19, a support position of the bearing 22*a* is entirely located on the more inner side than the reference position.

Figure 5:
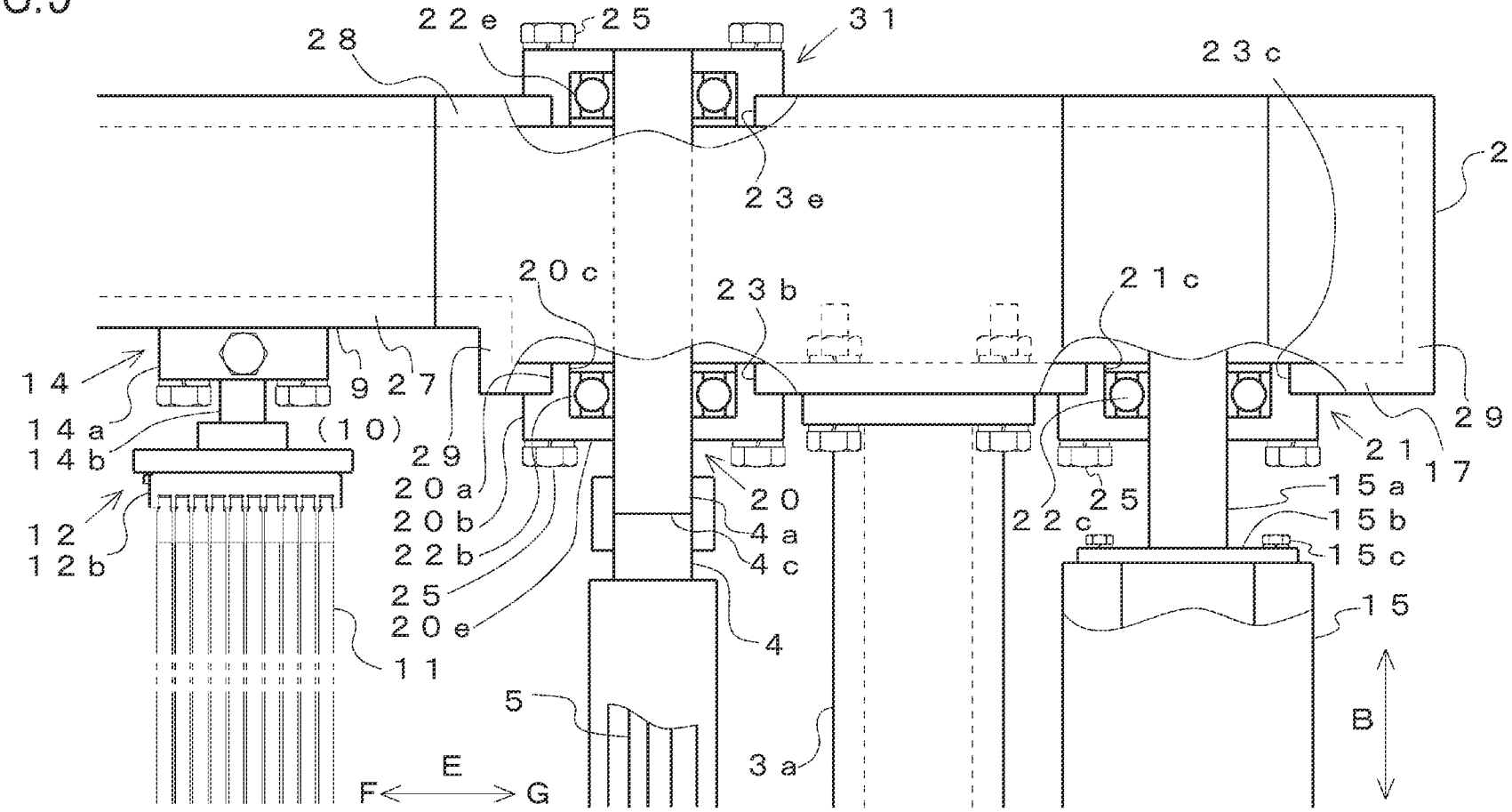
FIG. 5 is a partially enlarged sectional view of the frame of a loom shown in FIG. 1.

Note that, in the above, the support of the support shaft 16*a* for the main shaft 16 has been described. However, in the loom of the present embodiment, as shown in FIG. 5, each of the support shafts 4*a* for the rocking shaft 4 and each of the support shafts 15*a* for the cloth winding roll 15 are also attached to each side frame 2 via each of the bearing holders 20 and 21 having the same configuration as the bearing holder 19, as described above. Each of the bearing holders 20 is fixed to the side frame 2 in a form of being fitted/inserted in the through-hole 23*b* formed in the inner wall 27 of the side frame 2, and each of the bearing holders 21 is fixed to the side frame 2 in a form of being fitted/inserted in the through-hole 23*c* formed in the inner wall 27. Therefore, a part of the inner wall 27 in which the through-hole 23*b* is formed is formed as a support part for the support shaft 4*a*, and a part in which the through-hole 23*c* is formed is formed as a support part for the support shaft 15*a*.

Further, the through-hole 23*b* and the through-hole 23*c* are also formed in the protrusion part 17 of the inner wall 27 of the side frame 2, similar to the through-hole 23*a* Therefore, the support part for the support shaft 4*a* and the support part for the support shaft 15*a* on the inner wall 27 also correspond to the offset support part of the present invention. Although the support shaft 4*a* is supported in the bearing 22*b* accommodated in the bearing holder 20 and the support shaft 15*a* is supported in the bearing 22*c* accommodated in the bearing holder 21, the support positions of each of the bearing 22*b* and the bearing 22*c* are also entirely located on the more inner side than the reference position, similar to the bearing 22*a* accommodated in the bearing holder 19.

Further, in the loom of the present embodiment, the support shaft 16*a* for the main shaft 16 and the support shaft 4*a* for the rocking shaft 4 are supported in the inner wall 27 of the side frame 2, as described above, but are also supported in the outer wall 28. Therefore, the outer wall 28 of each side frame 2 is formed with a through-hole 23*d* for arranging the bearing 22*d* configured to support the support shaft 16*a* and a through-hole 23*e* for arranging the bearing 22*e* configured to support the support shaft 4*a*.

Bearing holders 30 and 31 for supporting the bearings 22*d* and 22*e* are each attached to each of the through-holes 23*d* and 23*e*. Note that, each of the bearing holders 30 and 31 has the same configuration as the bearing holder 19 and the like, and is also attached to the outer wall 28 (through-hole 23*d*; 23*e*) in the same manner as the bearing holder 19 and the like. Further, the bearing 22*d* is attached to the through-hole 23*d* of each side frame 2 in a form of being accommodated in the bearing holder 30, and the bearing 22*e* is attached to the through-hole 23*e* of each side frame 2 in a form of being accommodated in the bearing holder 31. In the outer wall 28 of each side frame 2, the support shaft 16*a* is supported in the bearing 22*d*, and the support shaft 4*a* is supported in the bearing 22*e*.

As described above, in the loom of the present embodiment, all of the support parts provided in the inner walls of both the side frames 2 and 2 are formed to be the offset support parts, and the positions of the inner ends of the bearings 22*a*, 22*b* and 22*c* arranged in the support parts are located on the more inner side than the reference position. Thereby, the positions of the connecting ends 16*c*. 4*c* and 15*b* of the support shafts 16*a*, 4*a* and 15*a* are located on the more inner side, as compared to a configuration (conventional configuration) of the loom of the related art where the position of the inner end of the bearing in each of the support parts is substantially the same as the reference position. Therefore, an interval between each of the pairs of connecting ends 16*c* and 16*c*, 4*c* and 4*c* and 15*b* and 15*b* is smaller, as compared to the conventional configuration. As a result, each of the shaft members 16, 4 and 15 bridged between the pair of corresponding support shafts is reduced in length dimension, as compared to the conventional configuration, and is thus more difficult to bend. Therefore, an amplitude of vibrations that occur on each of the shaft members 16, 4 and 15 during weaving is smaller, as compared to the conventional configuration.

Further, each side frame 2 is formed so that a part of the inner wall 27 becoming the protrusion part 17 protrudes with respect to the reference surface 10, and a peripheral part of the protrusion part 17 is formed as the wall part 29 in the width direction. Thereby, the vibration-proof characteristic of each side frame 2 itself is improved, as compared to the conventional configuration where the inner wall of the side frame is formed substantially planar.

In this way, in the present embodiment, all of the shaft members 16, 4 and 15, which are vibration generating sources of the vibrations of the side frame 2, are each configured such that an amplitude of the vibrations during weaving is smaller, as compared to the conventional configuration, and the vibration-proof characteristic of each side frame 2 itself is improved. Therefore, according to such a loom, the vibrations that occur on the entire loom frame during the weaving are further suppressed, as compared to the conventional configuration, and the noise problem and the bad influence on the weaving are suppressed as much as possible.

Particularly, in the loom, for the rocking shaft 4 that vibrates violently due to an influence of a beating motion during the weaving and the main shaft 16 mechanically connected to the rocking shaft 4, each of the support parts of the support shaft 4*a* for the rocking shaft 4 and the support shaft 16*a* for the main shaft 16 is formed to be the offset support part, as described above. Therefore, the vibrations of the entire loom frame caused in association with the weaving are more effectively suppressed.

Further, in the loom, as described above, the support positions of the bearings 22*a*, 22*b* and 22*c* in each of the offset support parts are entirely located on the more inner side than the reference position. Thereby, the wall part 29 is formed larger and the stiffness of each side frame 2 is further increased, so that the vibration-proof characteristic is more effectively improved.

Although one embodiment of the loom of the present invention has been described, the loom of the present invention is not limited to the above embodiment, and can be implemented in following modified embodiments.

(1) In the loom of the above embodiment, as for the offset support part, the support positions of the bearings 22*a*, 22*b* and 22*c* in each of the support parts formed to be the offset support parts are entirely located on the more inner side than the reference position. However, in the loom of the present invention, the offset support part may also be formed such that the inner end in at least the support position is located on the more inner side than the reference position. Specifically, the offset support part may also be formed such that the support position of the bearing overlaps the reference surface 10 (reference position) in the width direction.

For example, as for the side frame configured as described above, instead of the configuration where the protrusion part 17 is formed so that the protruding amount from the reference position is greater than the thickness dimension of the inner wall 27, the protrusion part 17 may be formed so that the protruding amount is smaller than the thickness dimension of the inner wall 27. In this case, when the bearing holders 19, 20 and 21 each have the same configuration as the above embodiment, the support position of each of the bearings 22*a*, 22*b* and 22*c* overlaps the reference position in the width direction.

Further, in the above embodiment, each side frame is configured such that all of the three support parts are to be the offset support parts. Further, the protrusion part 17 provided with each of the support parts is formed so that the protruding amount is the same over the entire protrusion part so that the inner surface 9 is flat. Thereby, the positions of each of the support parts in the width direction are the same. As a result, the support positions of each of the bearings by each of the support parts are also the same in the width direction. However, in the loom of the present invention, when the plurality of support parts is provided to be the offset support parts, the support parts may be provided so that the positions of some of the support parts (support positions) are different from the other support parts (support positions).

For example, in a case where all of the three support parts are the offset support parts, like the above embodiment, the protrusion part may be formed such that a part including the part, in which the through-hole 23*b* to be the support part for the rocking shaft 4 (support shaft 4*a*) is formed, more protrudes than the other part. In this case, when each of the bearing holders 19, 20 and 21 has the same configuration as the above embodiment, the support position of the bearing 22*b* in the support part for the rocking shaft 4 (support shaft 4*a*) becomes a position (the position on the inner side) different from the support positions of the bearings in the support parts for the other shaft members 16 and 15 (support shafts 16*a* and 15*a*).

(2) Further, in the above embodiment, in the loom where each side frame is configured such that all of the three support parts are to be the offset support parts, a part of the inner wall 27 of each side frame, which is to be the protrusion part 17, is formed over a range including all of the parts becoming the support parts. Specifically, in the loom of the above embodiment, each side frame is formed such that all of the support parts formed to be the offset support parts are included in the single protrusion part 17. However, in the loom of the present invention, when the plurality of support parts are provided to be the offset support parts, some of the support parts may be provided in a protrusion part formed separately from the protrusion part provided with the other support parts. Alternatively, each of the support parts (offset support parts) may be provided in separate protrusion parts each formed in association with each of the support parts.

For example, in a case where all of the three support parts are the offset support parts, like the above embodiment, a protrusion part in which each of the support parts for the main shaft 16 (support shaft 16*a*) and the rocking shaft 4 (support shaft 4*a*) located closer to the heddle frame 11 than the front top stay 3*a* is formed and a protrusion part in which the support part for the cloth winding roll 15 (support shaft 15*a*) located on the winding-side with respect to the front top stay 3*a* is formed may be formed as separate protrusion parts that are not continuous.

(3) In the above embodiment, as for the shaft member (hereinafter, referred to as "target shaft member") for which the support part is formed as the offset support part, all of the three shaft members are the target shaft members. Each side frame is provided on the inner wall with the protrusion part so that all of the three support parts are the offset support parts. However, the loom of the present invention may also be configured such that one or two of the three shaft members are the target shaft members. In this case, each side frame is configured so that the support part for each target shaft member is to be the offset support part. Specifically, each side frame may be formed such that a part of a range, which includes the support part for the target shaft member, of the part of the inner wall 27 becoming the three support parts is to be the protrusion part.

(4) In the above embodiment, both the side frames 2 and 2 are formed such that the range on the inner wall 27 including each of the support parts is to be the protrusion part so that the support parts on both sides for each of the three shaft members are to be the offset support parts. Specifically, both the side frames 2 and 2 are each formed on the inner wall with the protrusion part so that the support parts on both sides for each shaft member are to be the offset support parts. However, in the loom of the present invention, even when only one of the support parts on both sides for the target shaft member is the offset support part, the vibration suppression effect is obtained, as compared to the loom of the related art. Therefore, the side frame may also be formed on the inner wall with the protrusion part in such a form that only the support part on one side for the target shaft member is the offset support part.

However, in a case where the plurality of shaft members is formed as the target shaft members, the present invention is not limited to a configuration where the support parts for all of the target shaft members are formed to be the same. For example, in a case where the two shaft members are formed as the target shaft members, both the support parts for one target shaft member may be formed as the offset support parts, and only one of the support parts for the other target beam member may be formed as the offset support part. Also in a case where the support parts for the plurality of target shaft members are formed to be the offset support parts only on one side, the support parts becoming the offset support parts are not limited to a configuration where all are the support parts of the same side frame.

Note that, the present invention is not limited to any embodiment described above, and can be changed as appropriate without departing from the gist thereof.

What is claimed is:

1. A loom comprising a loom frame comprising a pair of side frames, and heddle frame guides each attached to each of the side frames and configured to guide up-and-down movement of a heddle frame, wherein a rocking shaft, a main shaft, and a cloth winding roll bridged between both the side frames are supported on each of the side frames via support shafts and the support shafts are supported via bearings fitted in support parts provided in at least inner walls of the side frames, the loom being characterized in that the inner wall of at least one side frame has, as a reference position, a position of a part, which supports the heddle frame guide in a warp direction, of an inner surface of the inner wall with respect to a width direction of the loom and at least one support part is formed to be an offset support part at which an inner end in a support position of the bearing is located on a more inner side of the loom frame than the reference position.

2. The loom according to claim 1, wherein the support position is located on the more inner side than the reference position.

3. The loom according to claim 1, wherein the offset support part is the support part configured to support the support shaft connected to the rocking shaft and/or the main shaft.

4. The loom according to claim 2, wherein the offset support part is the support part configured to support the support shaft connected to the rocking shaft and/or the main shaft.

* * * * *